US006403024B1

(12) United States Patent
Oota et al.

(10) Patent No.: US 6,403,024 B1
(45) Date of Patent: Jun. 11, 2002

(54) HYDROGEN PULVERIZER FOR RARE-EARTH ALLOY MAGNETIC MATERIAL POWDER USING THE PULVERIZER, AND METHOD FOR PRODUCING MAGNET USING THE PULVERIZER

(75) Inventors: Akiyasu Oota, Sanda; Akihito Tsujimoto, Wakayama; Katsumi Okayama, Kusatsu, all of (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/503,738

(22) Filed: Feb. 15, 2000

(30) Foreign Application Priority Data

Feb. 19, 1999 (JP) ..... 11-041341

(51) Int. Cl.[7] ..... B22F 3/12
(52) U.S. Cl. ..... 419/33; 419/38; 241/30
(58) Field of Search ..... 419/33, 38; 241/30

(56) References Cited

U.S. PATENT DOCUMENTS 5,431,747 A 7/1995 Takebuchi et al. ..... 148/302
6,247,660 B1 * 6/2001 Imai et al. ..... 241/30

FOREIGN PATENT DOCUMENTS

| | | |
|---|---|---|
| JP | 63-317643 | 12/1988 |
| JP | 5-295490 | 11/1993 |
| JP | 6-108104 | 4/1994 |
| JP | 6-349618 | 12/1994 |
| JP | 9-31609 | 2/1997 |
| JP | 9-170055 | 6/1997 |
| JP | 10-169957 | 6/1998 |

* cited by examiner

*Primary Examiner*—Ngoclan Mai
(74) *Attorney, Agent, or Firm*—Nixon Peabody LLP; Jeffrey L. Costellia

(57) ABSTRACT

A hydrogen pulverizer according to the present invention is an apparatus for subjecting a rare-earth alloy magnetic material to a hydrogen pulverization process. The apparatus includes: a hermetically sealable hydrogen furnace, which includes a furnace body with an opening and a cap for closing the opening; a loading chamber for temporarily enclosing the rare-earth alloy magnetic material when the rare-earth alloy magnetic material, which has been pulverized with hydrogen, is unloaded from the furnace body through the opening; and an inert gas supply for supplying an inert gas into the loading chamber.

23 Claims, 9 Drawing Sheets

HYDROGEN PULVERIZER FOR RARE-EARTH ALLOY MAGNETIC MATERIAL POWDER USING THE PULVERIZER, AND METHOD FOR PRODUCING MAGNET USING THE PULVERIZER

BACKGROUND OF THE INVENTION

The present invention relates to an apparatus for pulverizing rare-earth alloy magnetic materials through absorption and release of hydrogen (in this specification, such an apparatus will be called a "hydrogen pulverizer") The present invention also relates to respective methods for preparing rare-earth alloy magnetic material powder and producing a magnet using the hydrogen pulverizer.

A rare-earth sintered magnet is produced by pulverizing a magnetic alloy into alloy powder, pressworking and sintering the alloy powder and then subjecting the sintered alloy to aging treatment. Two types of rare-earth alloy magnets, namely, samarium-cobalt (Sm—Co) magnets and neodymium-iron-boron magnets, are used widely in various applications. In this specification, a rare-earth alloy magnet of the latter type will be referred to as an "R—T—(M)—B magnet", where R is a rare-earth element including Y, T is Fe or a compound of Fe and at least one transition metal element, M is an additive and B is boron. Part of Fe in an R—Fe—B type magnet can be replaced with a transitional metal element, e.g., cobalt. The R—T—(M)—B magnet is often applied to many kinds of electronic units, because the maximum energy product thereof is the higher than any other kind of magnet and yet the cost thereof is relatively inexpensive.

In a conventional process of pulverizing material alloy for the R—T—(M)—B magnet, a container made of stainless steel like SUS304 is loaded with the magnetic material alloy powder and then primary pulverization of the material alloy is carried out in a hydrogen furnace, where hydrogen is absorbed and released into/out of the material alloy.

Methods for preparing the rare-earth alloy are roughly classified into the following two types. The first type is an ingot mold casting technique, in which a melt of material alloy is teemed into a mold and then cooled down relatively slowly. The second type is a quenching technique, such as a strip-casting process or a centrifugal casting process, in which a melt of material alloy is rapidly quenched by a single roll, twin rolls, a rotating disk, or a rotating cylinder, thereby forming, out of the molten alloy, a solidified alloy, which is thinner than the alloy produced by the conventional ingot mold casting technique.

According to the quenching technique, the thickness of the resultant R—T—(M)—B magnet alloy is in the range from 0.03 mm to 10 mm, both inclusive. The molten alloy starts to solidify from the surface that has come into contact with the chill roll or its equivalents, and subsequently columnar crystals are growing from the surface in the thickness direction. As a result, the quenched alloy comes to have a structure including $R_2T_{14}B$ crystal grains and R-rich phases that exist dispersively along the $R_2T_{14}B$ crystal grain boundaries. The sizes of the $R_2T_{14}B$ crystal grain are in the range from 0.1 $\mu$m to 100 $\mu$m, both inclusive, in the minor axis direction and in the range from 5 $\mu$m to 500 $\mu$m, both inclusive, in the major axis direction. The R-rich phases are non-magnetic phases in which the concentration of the rare-earth element R is relatively high. The thickness of the R-rich phases, which corresponds to the width of the grain boundaries, is 10 $\mu$m or less.

Compared to an ingot alloy, i.e., alloy that has been prepared by the conventional mold casting process (i.e., die casting process), the quenched alloy has been cooled down in a relatively short period of time. Thus, the crystal structure or the grain size of the quenched alloy is finer than that of the ingot alloy. That is to say, the grain boundaries of the quenched alloy are greater in area, and the R-rich phases exist in the grain boundaries. Accordingly, the quenched alloy is also superior to the ingot alloy in terms of dispersiveness of the R-rich phases.

The quenched alloy is likely to fracture at the grain boundaries during a hydrogen pulverizing process. For that reason, the R-rich phases easily appear on the surface of the alloy powder particles that are obtained by pulverizing the quenched alloy. In the R-rich phases, R easily reacts with oxygen. Accordingly, the quenched alloy powder is very likely to be oxidized, generate heat and spontaneously ignite. Thus, it is believed that the magnetic properties of the strip-cast alloy powder are deteriorative considerably.

Next, a known hydrogen pulverization process for the ingot alloy will be described.

First, a process container in the shape of a flat pack is filled with magnetic alloy blocks (each having a length of about 3 cm on each side) that have been cast in a water-cooled casting die, and then loaded into a rack. After the rack has been inserted into a hydrogen furnace, the pressure inside the furnace is reduced using a vacuum pump. Then, hydrogen gas is supplied into the hydrogen furnace, thereby getting hydrogen absorbed into the material alloy. After a predetermined time has passed, the material alloy is heated while evacuating the hydrogen furnace again, thereby getting hydrogen released from the material alloy. Once a sufficient quantity of hydrogen has been released from the material alloy and the alloy has been cooled down, the cap of the hydrogen furnace is opened and the rack, which is loaded with the process containers, is ejected to the air. At the point in time that the hydrogen pulverization process is finished, the alloy has been roughly broken up to a size of about 1 cm. Thereafter, the material, which has been pulverized roughly through this hydrogen process, is taken out of the container, ground finely to a size of about 10 $\mu$m to about 400 $\mu$m using a disk mill and then pulverized even more finely to an average particle size of about 2 $\mu$m to about 5 $\mu$m using a jet mill, for example.

A green compact (or as-pressed compact) is formed, by compaction, out of the material alloy fine powder prepared this way. Thereafter, the compact is subjected to sintering, aging treatment and so on to produce a sintered magnet.

According to the conventional process, however, resulting magnetic properties deteriorate. This is because when the material is ejected out of the hydrogen furnace to the air, the rare-earth element R contained in the hydrogen-pulverized material is oxidized due to the contact with the air.

Suppose the source material contains neodymium as the rare-earth element R, for example. In such a case, $NdH_3$ is formed by getting hydrogen absorbed into the material, while $NdH_3$ changes into $NdH_2$ by getting hydrogen released from the material. In an actual mass production process, however, hydrogen cannot be released completely, and $NdH_3$ is almost always left in part of the material. At the core of the process container, in particular, plenty of $NdH_3$ might be left because the core cannot always be heat-treated sufficiently. If $NdH_3$ remains in the material, then that $NdH_3$ is exposed to the air to generate heat when the material is ejected out of the process container. Accordingly, in practice, a cooling period should be provided after the material has been taken out. In other words, the fine pulverization and other subsequent process steps cannot be started immediately. What is worse, there is a risk of spontaneous ignition.

We found that the probability of heat generation and spontaneous ignition due to oxidation is remarkably high when the hydrogen pulverization process is applied to the quenched alloy produced by the quenching technique (e.g., the strip-cast process), in particular. Thus, we concluded that it is extremely difficult to realize an industrialized quenched alloy pulverization process according to the conventional technique. Hereinafter, this point will be detailed.

Compared to the ingot alloy, the quenched alloy is thinner and has a finer metal structure. Accordingly, most of the quenched alloy has already been pulverized sufficiently (e.g., with an average size of 1.0 mm or less) when the hydrogen pulverization process on the alloy is over. Thus, the total surface area of the pulverized alloy is greater. Also, since R-rich phases exist with high dispersiveness, the R-rich phases are likely to appear on the surface of the hydrogen-pulverized powder. For these reasons, a large quantity of unreacted, active rare-earth element R is exposed on the surface of the strip-cast alloy powder that has just been subjected to the hydrogen pulverization process, and is very likely to be oxidized. Accordingly, there is a risk of spontaneous ignition unless the as-pulverized powder is cooled down to room temperature (i.e., about 20° C.). Also, if the large quantity of rare-earth element exposed is oxidized or nitrided, the magnetic properties of a final magnet product are deteriorative considerably.

Even if the hydrogen-pulverized powder is cooled down within t he furnace using an inert gas at a low temperature to suppress such oxidation and nitriding reactions, some problems still happen. Specifically, when the cap of the furnace is opened, condensation is produced inside the furnace in such a case. As a result, vacuum pumping for the next lot will take a long time, because the water vaporizes inside the furnace. In addition, since the quenched alloy is pulverized into particularly fine powder, the as-pulverized alloy powder is hard to ventilate. That is to say, it is difficult for the cooling inert gas to remove sufficient heat from the pulverized powder, thus taking an adversely long time to cool the powder down and ultimately decreasing the productivity considerably.

SUMMARY OF THE INVENTION object of the present invention is providing a hydrogen pulverizer that can perform the hydrogen pulverization and subsequent cooling processes more efficiently and safely with the total processing time shortened.

Another object of the present invention is providing a hydrogen pulverizer that can contribute to improvement in magnetic properties of a resultant magnet by preventing the material from being oxidized.

Still another object of the present invention is providing respective methods for preparing rare-earth alloy magnetic material powder and producing a magnet, by which the pulverization process can be carried out more efficiently and safely even on a rapidly-quenched alloy with a fine structure such as a strip-cast alloy.

An inventive hydrogen pulverizer is an apparatus for subjecting a rare-earth alloy magnetic material to a hydrogen pulverization process. The apparatus includes: a hermetically sealable hydrogen furnace, which includes a furnace body with an opening and a cap for closing the opening; a loading chamber for temporarily enclosing the rare-earth alloy magnetic material when the rare-earth alloy magnetic material, which has been pulverized with hydrogen, is unloaded from the furnace body through the opening; and means for supplying an inert gas into the loading chamber.

In one embodiment of the present invention, the cap of the hydrogen furnace may move inside the loading chamber to open or close the opening of the furnace body.

Alternatively or additionally, the loading chamber may include a door, and when the door is closed, a substantially airtight condition is created within the loading chamber.

In an alternate embodiment, the apparatus may further include a cooling system for supplying, into the hydrogen furnace, the inert gas at room temperature and the inert gas that has been cooled down in this order.

An inventive rotary cooler includes: a cooling cylinder supported in a freely rotatable position; cooling means for cooling down the cooling cylinder; control means for controlling the number of revolutions per minute of the cooling cylinder; and temperature sensing means provided for the cooling cylinder. The control means controls the number of revolutions per minute of the cooling cylinder based on the output of the temperature sensing means.

An inventive method for pulverizing a rare-earth alloy magnetic material with hydrogen is carried out by using an apparatus including: a hermetically sealable hydrogen furnace, which includes a furnace body with an opening and a cap for closing the opening; a loading chamber for temporarily enclosing the rare-earth alloy magnetic material when the rare-earth alloy magnetic material, which has been pulverized with hydrogen, is unloaded from the furnace body through the opening; and means for supplying an inert gas into the loading chamber.

An inventive method for preparing a rare-earth alloy magnetic material powder includes the step of pulverizing a rare-earth alloy magnetic material with hydrogen by using an apparatus. The apparatus includes: a hermetically sealable hydrogen furnace, which includes a furnace body with an opening and a cap for closing the opening; a loading chamber for temporarily enclosing the rare-earth alloy magnetic material when the rare-earth alloy magnetic material, which has been pulverized with hydrogen, is unloaded from the furnace body through the opening; and means for supplying an inert gas into the loading chamber. The method further includes the step of unloading the rare-earth alloy magnetic material from the apparatus and moving the material into an inert gas environment while supplying the inert gas into the loading chamber of the apparatus.

In one embodiment of the present invention, the method may further include the step of receiving the rare-earth alloy magnetic material that has been unloaded from the apparatus and then transporting the material using a transporter including means for supplying the inert gas into the transporter itself.

Alternatively or additionally, the method may further include the step of cooling down the rare-earth alloy magnetic material that has been pulverized with hydrogen by supplying the inert gas into the hydrogen furnace of the apparatus.

In this particular embodiment, the inert gas supplied into the hydrogen furnace of the apparatus is preferably circulated and used cyclically.

More specifically, the material is preferably cooled down to a predetermined temperature using, as the inert gas supplied into the hydrogen furnace of the apparatus, a cooled inert gas and then further cooled down using an inert gas at about room temperature.

In another embodiment of the present invention, the method may further include the step of unloading the rare-earth alloy magnetic material from the transporter inside a housing that is filled with the inert gas.

In still another embodiment, the method may further include the step of cooling down the rare-earth alloy magnetic material inside a cooling system that is filled with the inert gas.

An inventive method for producing a magnet includes the steps of: pulverizing a rare-earth alloy magnetic material using the apparatus according to the present invention; unloading the rare-earth alloy magnetic material from the apparatus and moving the material into the loading chamber filled with the inert gas; transporting the rare-earth alloy magnetic material that has been unloaded from the apparatus using a transporter including means for supplying the inert gas into the transporter itself; unloading the rare-earth alloy magnetic material from the transporter inside a housing that is filled with the inert gas, and cooling down the rare-earth alloy magnetic material inside a cooling system that is filled with the inert gas; making fine powder of the rare-earth alloy magnetic material by further pulverizing the rare-earth alloy magnetic material; and producing a magnet by compacting and sintering the fine powder of the rare-earth alloy magnetic material.

In one embodiment of the present invention, the method may further include the step of cooling down the rare-earth alloy magnetic material that has been pulverized with hydrogen by supplying the inert gas into the hydrogen furnace of the apparatus.

In this particular embodiment, the inert gas supplied into the hydrogen furnace of the apparatus is preferably circulated and used cyclically.

Alternatively or additionally, the material may be cooled down to a predetermined temperature using, as the inert gas supplied into the hydrogen furnace of the apparatus, a cooled inert gas and then further cooled down using an inert gas at about room temperature.

Another method for preparing a rare-earth alloy magnetic material powder according to the present invention includes the step of embrittling a rare-earth magnetic material alloy within a furnace with hydrogen supplied into the furnace. The alloy contains: $R_2T_{14}B$ crystal grains, where R is a rare-earth element, T is Fe or a compound of Fe and at least one transition metal and B is boron; and R-rich phases existing dispersively in grain boundaries of the $R_2T_{14}B$ crystal grains. The sizes of the $R_2T_{14}B$ crystal grains are in the range from 0.1 $\mu$m to 100 $\mu$m, both inclusive, in a minor axis direction and in the range from 5 $\mu$m to 500 $\mu$m, both inclusive, in a major axis direction. The thickness of the alloy is in the range from 0.03 mm to 10 mm, both inclusive. The method further includes the step of unloading the alloy from the furnace within an inert gas environment.

Still another method for preparing a rare-earth alloy magnetic material powder according to the present invention includes the step of embrittling a rare-earth magnetic alloy within a furnace with hydrogen supplied into the furnace. The rare-earth magnetic alloy has been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal element and B is boron, have grown in the alloy in the thickness direction thereof. The method further includes the step of unloading the alloy from the furnace within an inert gas environment.

In one embodiment of the present invention, the method may further include the steps of: cooling down the alloy, which has been embrittled with hydrogen, within the furnace; and moving the alloy, which has been unloaded from the furnace, into a cooling system and cooling down the alloy within the cooling system.

In this particular embodiment, the method preferably further includes the step of introducing the alloy into a process container and loading the container into the furnace before the alloy is embrittled with hydrogen. In the step of unloading the alloy from the furnace, the process container is preferably unloaded from the furnace within the inert gas environment, and the alloy is preferably cooled down within the cooling system after having been taken out of the process container.

In another embodiment of the present invention, the inert gas environment may be argon or helium gas environment.

In an alternative embodiment, the method may further include the step of cooling down the alloy within an inert gas environment after the alloy has been unloaded from the furnace.

In still another embodiment, the alloy may be cooled down while being stirred up within the inert gas environment.

Yet another method for preparing a rare-earth alloy magnetic material powder according to the present invention includes the step of embrittling a rare-earth magnetic alloy within a furnace with hydrogen supplied into the furnace. The rare-earth magnetic alloy has been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal element and B is boron, have grown in the alloy in the thickness direction thereof. The method further includes the step of unloading the alloy from the furnace and cooling the alloy down within a cooling system while stirring the alloy up within an inert gas environment.

In one embodiment of the present invention, the cooling system may include a cylindrical member that is driven to rotate, and the number of revolutions per minute of the cylindrical member may be controlled based on the output of means for sensing the temperature of the alloy.

Another inventive method for producing a magnet includes the step of embrittling a rare-earth magnetic material alloy within a furnace with hydrogen supplied into the furnace. The alloy contains: $R_2T_{14}B$ crystal grains, where R is a rare-earth element, T is Fe or a compound of Fe and at least one transition metal and B is boron; and R-rich phases existing dispersively in grain boundaries of the $R_2T_{14}B$ crystal grains. The sizes of the $R_2T_{14}B$ crystal grains are in the range from 0.1 $\mu$m to 100 $\mu$m, both inclusive, in a minor axis direction and in the range from 5 $\mu$m to 500 $\mu$m, both inclusive, in a major axis direction. The thickness of the alloy is in the range from 0.03 mm to 10 mm, both inclusive. The method further includes the steps of: unloading the alloy from the furnace within an inert gas environment; compacting powder of the alloy; and sintering the compacted alloy.

Still another inventive method for producing a magnet includes the step of embrittling a rare-earth magnetic alloy within a furnace with hydrogen supplied into the furnace. The rare-earth magnetic alloy has been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal element and B is boron, have grown in the alloy in the thickness direction thereof. The method further includes the steps of: unloading the alloy from the furnace within an inert gas environment, compacting powder of the alloy; and sintering the compacted alloy.

DESCRIPTION OF THE PREFERRED EMBODIMENTS

Hereinafter, preferred embodiments of the present invention will be described with reference to the accompanying drawings.

Hydrogen Pulverizer

Figure 1:
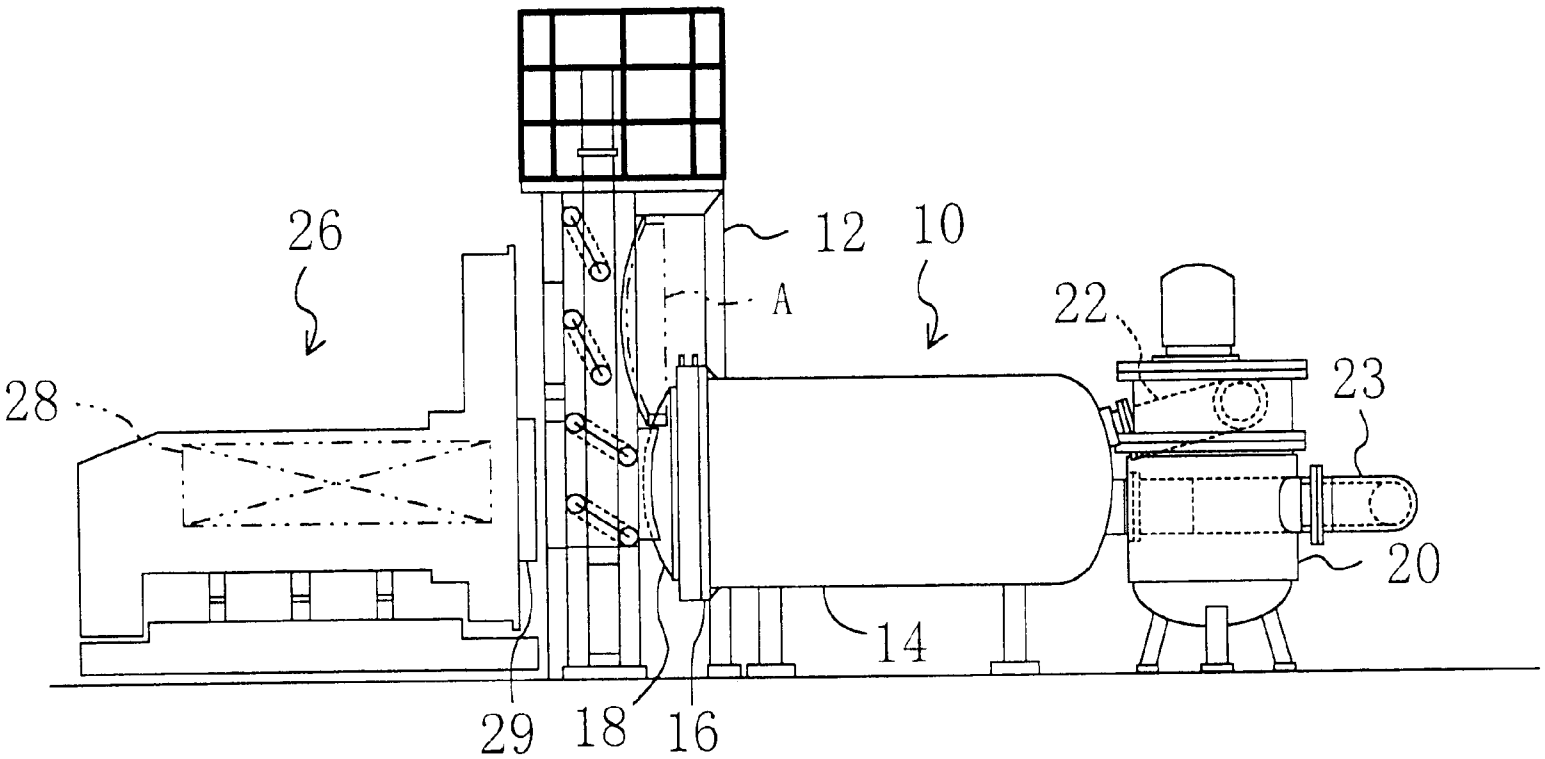
FIG. 1 is a side view illustrating an exemplary embodiment of hydrogen pulverizer and material transporter according to the present invention.
Figure 2:
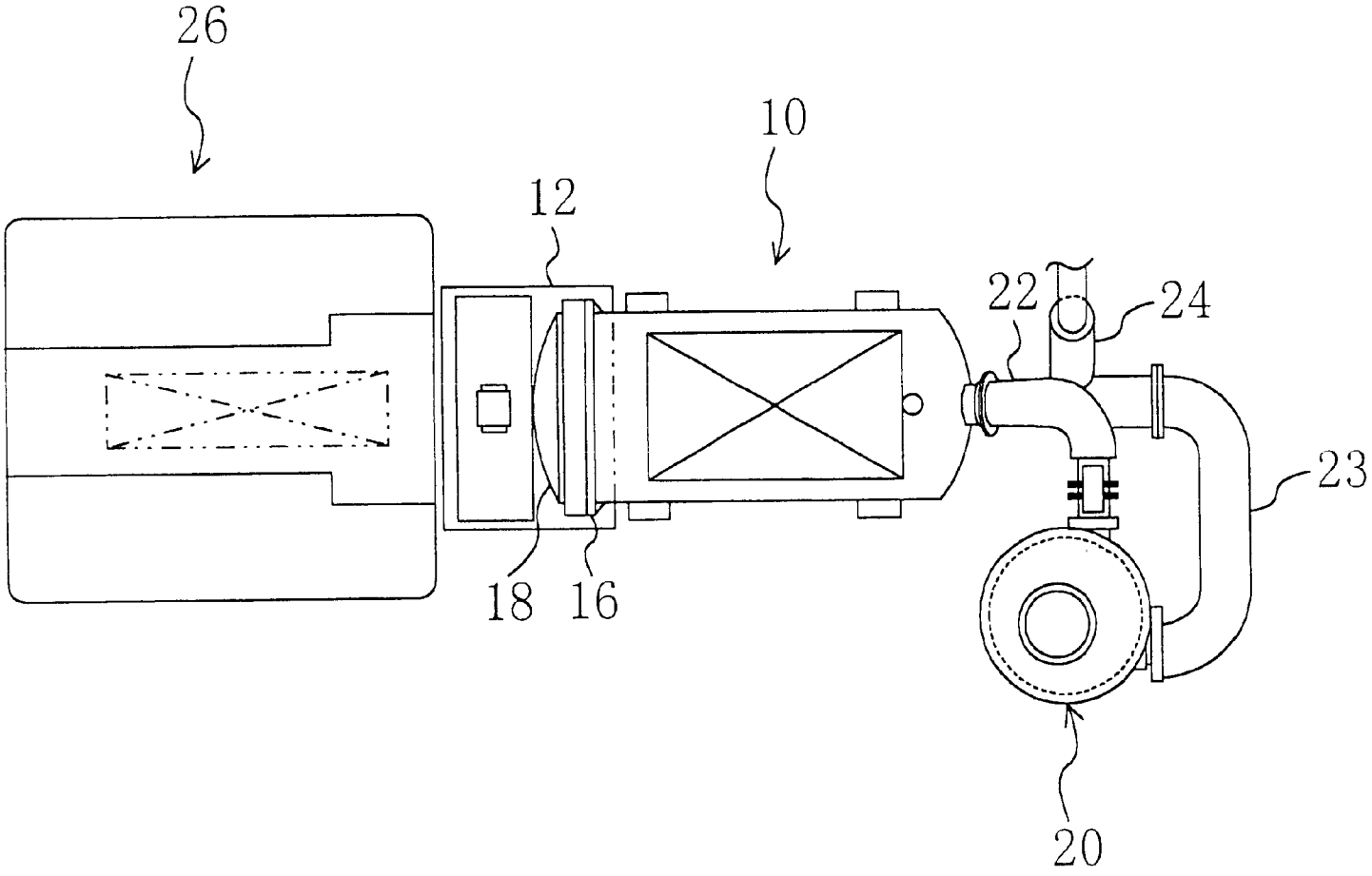
FIG. 2 is a top view of the hydrogen pulverizer and material transporter shown in FIG. 1.

FIG. 1 is a side view illustrating an exemplary embodiment of hydrogen pulverizer and material transporter 26 according to the present invention, while FIG. 2 is a top view thereof. The hydrogen pulverizer includes: a hydrogen furnace 10 with a conventional construction; and a specially designed loading chamber 12, which is provided in front of a loading port 16 of the hydrogen furnace 10. The hydrogen furnace 10 itself has almost the same construction as a general-purpose hydrogen furnace. Specifically, the hydrogen furnace 10 includes: a furnace body 14; and a cap 18, which is opened or closed to introduce an object to be processed into, and take out of, the space inside the body 14. In view of the brittleness to hydrogen, the furnace body 14 and the cap 18 are preferably made of stainless steel such as SUS304L, SUS316 or SUS316L. The inner volume of the furnace may be in the range from about 3.0 $m^3$ to about 5.2 $m^3$, for example.

Multiple pipes, including hydrogen gas inlet pipe, argon gas inlet pipe and exhaust pipe, are coupled to the furnace body 14 and the former two pipes are identified collectively by the reference numeral 22 in FIGS. 1 and 2.

As shown in FIG. 2, the gas inlet pipes 22 are connected to a cooling system 20 so that the temperature of the gases introduced into the hydrogen furnace 10 is regulable using the cooling system 20. The exhaust pipe 24 is connected to an exhaust system (not shown) such as a Roots vacuum pump or oil-sealed rotary vacuum pump.

Inside the furnace body 14, placed is a heater (not shown) made of graphite, for example, which is resistant to hydrogen gas. Power is supplied to the heater from a feeder (not shown), which is provided outside of the furnace.

The types and pressures of the ambient gases introduced into the hydrogen furnace 10 are controlled in accordance with a preset program by adjusting the flow rates of the gases supplied into the furnace and flow rates of the gases pumped out of the furnace. Also, the temperatures of the ambient gases inside the hydrogen furnace 10 are controllable to follow the predetermined temperature profile using the heater or the cooling system 20 by reference to the output of a temperature sensor provided inside the furnace. Such temperature control is carried out by a controller (not shown).

The argon gas that is supplied into the furnace via the gas inlet pipes 22 is used to cool down the material that has just been heated. In the illustrated embodiment, the argon gas used is recovered and recycled through a pipe 23 to improve the cost effectiveness of the hydrogen pulverization process. Optionally, any inert gas other than argon gas, e.g., helium gas, may also be used instead.

The cap 18 of the hydrogen furnace 10 is closed at least during the hydrogen pulverization process, thereby keeping the space inside the furnace hermetically sealed completely during the process. When the material is introduced or taken out, the cap 18 of the hydrogen furnace 10 is moved upward by a driving mechanism to open the loading port 16 of the hydrogen furnace 10. In FIG. 1, the cap 18 closed is represented by the solid line, while the cap 18 opened is represented by the two-dot chain A.

The furnace body 14 and the cap 18 are constructed to have such strength as to make the inside of the furnace resistible to both pressurized and reduced-pressure states. Thus, hydrogen pulverization processes of various types can be carried out safely using this furnace.

The hydrogen pulverizer of the present invention is characterized by including the loading chamber 12, which is provided in front of, and coupled to, the loading port 16 of the hydrogen furnace 10 such that the loading chamber 12 can be filled with an inert gas like argon or helium gas. The loading chamber 12 does not have to be so constructed as to produce completely airtight state. The loading chamber 12 is just required to minimize the air flowing into the chamber 12 to such an extent that heat generated due to the exposure of the pulverized material to the air is sufficiently reduced when the pulverized material is taken out of the furnace 10 through the loading port 16. Alternatively, only the pulverized material may be covered with a boxlike member so long as the material is not exposed to the air.

Figure 8:
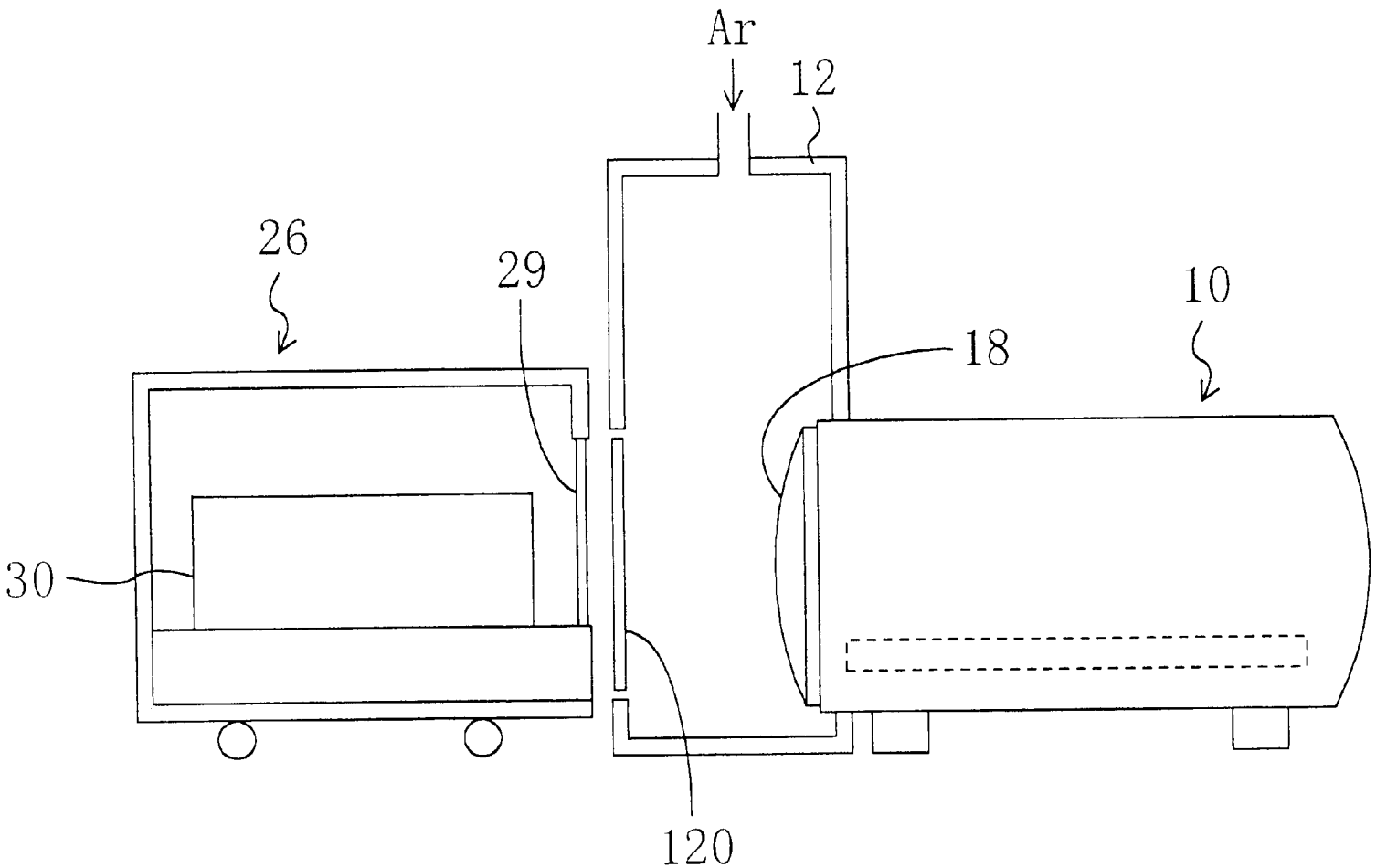
FIG. 8 schematically illustrates an exemplary loading chamber provided for the hydrogen pulverizer of the present invention.

FIG. 8 schematically illustrates the configuration of the loading chamber 12. As shown in FIG. 8, the loading chamber 12 has only to enclose the space in front of the loading port 16 of the hydrogen furnace 10 with a thin steel plate, for example. Accordingly, the shape of the chamber 12 is not limited to any specific one. In the illustrated embodiment, the loading chamber 12 includes a door 120, which slides substantially vertically. And the material is introduced or taken out with the door 120 opened. Also, the size and shape of the loading chamber 12 are so defined as to make the cap 18 of the hydrogen furnace 10 openable or closable within the loading chamber 12. The inner volume of the chamber 12 may be in the range from about 5.0 $m^3$ to about 6.0 $m^3$.

By providing such a loading chamber 12, the rare-earth alloy magnetic material with increased reactivity as a result of the hydrogen pulverization process can be moved into the material transporter 26 substantially without being exposed to the air.

The flow rate of the inert gas supplied into the loading chamber 12 may be defined within the range from 1000 to 2000 NL/min such that the as in a quantity about threefold of the inner volume of the loading chamber 12 can be supplied in a short time. If the inert gas is supplied at such a flow rate, then the concentrations of oxygen and water vapor existing inside the loading chamber 12 decrease to such levels as substantially reducing the possibility of oxidation reaction in about 3 to 10 minutes. According to the present invention, the inert gas is used to form an inert gas environment for the hydrogen-processed rare-earth alloy magnetic material. The "inert gas environment" may contain small amount of active gas components such as oxygen ($O_2$) and/or nitrogen ($N_2$). The amount Of $O_2$ in the inert gas environment is preferably less than or equal to 5 mol % and the amount of $N_2$ in the inert gas environment is preferably less than or equal to 20 mol %. More preferably, the amount of $O_2$ in the inert gas environment is less than or equal to 1 mol % and the amount of $N_2$ in the inert gas environment is less than or equal to 4 mol %.

Figure 3:
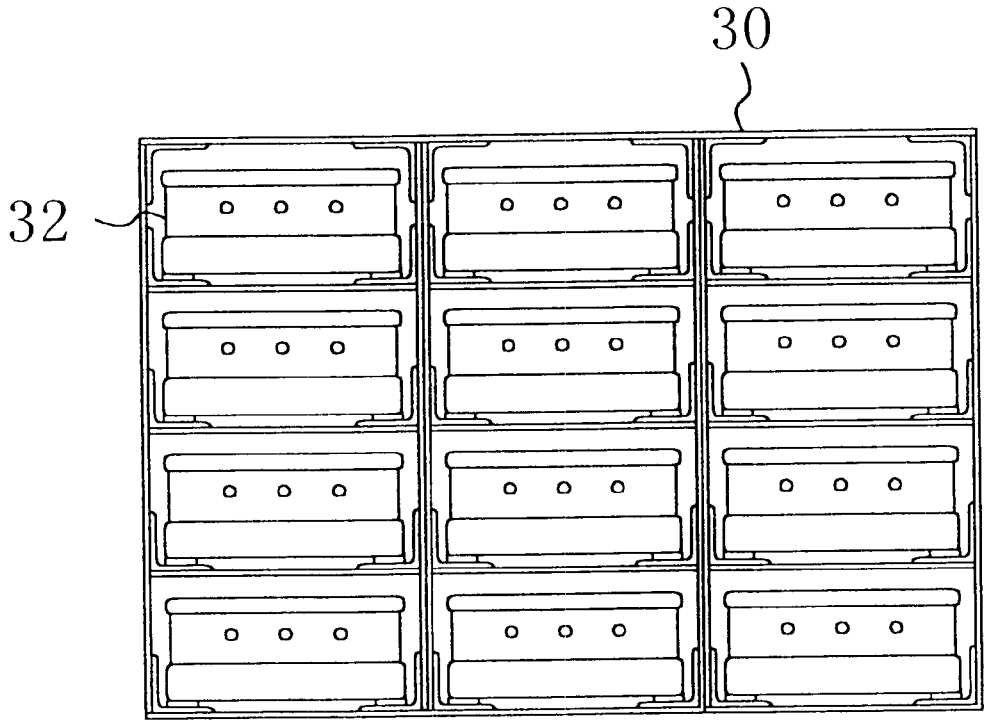
FIG. 3 illustrates a rack loaded with multiple material packs.

In the illustrated embodiment, multiple material packs 32 (size: 30 mm×15 mm×50 mm) are loaded into a rack 30 as shown in FIG. 3 and subjected to the hydrogen pulverization process in such a state. Each of the material packs 32 is a boxlike container made of some material with a good thermal conductivity, e.g., copper. The rack 30 may also be made of stainless steel such as SUS304L, SUS316 or SUS316L just like the furnace body.

A member for supporting the bottom of the rack 30 thereon is placed inside the hydrogen furnace 10. That is to say, the rack 30, which has been transported by the transporter 26, is mounted onto the support member and then inserted deep into the hydrogen furnace. When a single material transporter 26 can transport a plurality of rack 30 at a time, these rack 30 are preferably loaded into the hydrogen furnace 10 and subjected to the hydrogen pulverization process at the same time.

Each of the material packs 32 is preferably partially filled with the material such that the depth of the material as measured from the surface becomes about 10 cm. This depth is selected to make the entire material be exposed to hydrogen uniformly. That is to say, if a deep container is fully filled with a great deal of material, then the material might be hard to pulverize uniformly with hydrogen.

Material Transporter

The material transporter 26 shown in FIGS. 1 and 2 can transport the rare-earth magnetic alloy material automatically to any designated place within a plant in accordance with the instruction of a central processing unit. The material transporter 26 includes wheels and a body supported on the wheels. The transporter 26 follows a specified course by driving the wheels using some driving means (not shown) such as a motor built in the body thereof. Preferably, multiple guide tracks are drawn on the floor of the plant in advance to make the transporter follow a predetermined one of the tracks that has been sensed by a sensor provided for the transporter 26. Alternatively, the transportation operation may be performed by any other control technique.

In the illustrated embodiment, the inner space 28 of the material transporter 26 is large enough to store the rack 30 containing the material in its entirety, and may be filled with an inert gas during the transportation to form the "inert gas environment" for the hydrogen-processed material. When the rack 30 is loaded into, or unloaded from, the material transporter 26, the door 29 of the material transporter 26 is opened. During the transportation, however, the door 29 is closed. The rack 30 is loaded into, and unloaded from, the material transporter 26 by a loader provided for the transporter 26. Specifically, the loader moves horizontally while gripping a predetermined part of the rack 30 for that purpose.

When the material transporter 26 arrives in front of the loading chamber 12 of a designated hydrogen furnace 10,the position of the material transporter 26 is adjusted such that the door 29 of the transporter 26 faces the door 120 of the loading chamber 12. And then the door 120 of the loading chamber 12 slides upward almost vertically and pens. At the same time, the door 29 of the material transporter 26 also slides and opens. Thereafter, the rack 30 containing a new material is unloaded from inside the material transporter 26 and loaded into the hydrogen furnace 10. Or the rack 30 containing a pulverized material is unloaded from the hydrogen furnace 10 and loaded into the material transporter 26. During the hydrogen pulverization process, the material transporter 26 does not have to stand still in front of the loading chamber 12, but may be moving to carry out other transportation operations.

Rotary Cooler

Figure 4:
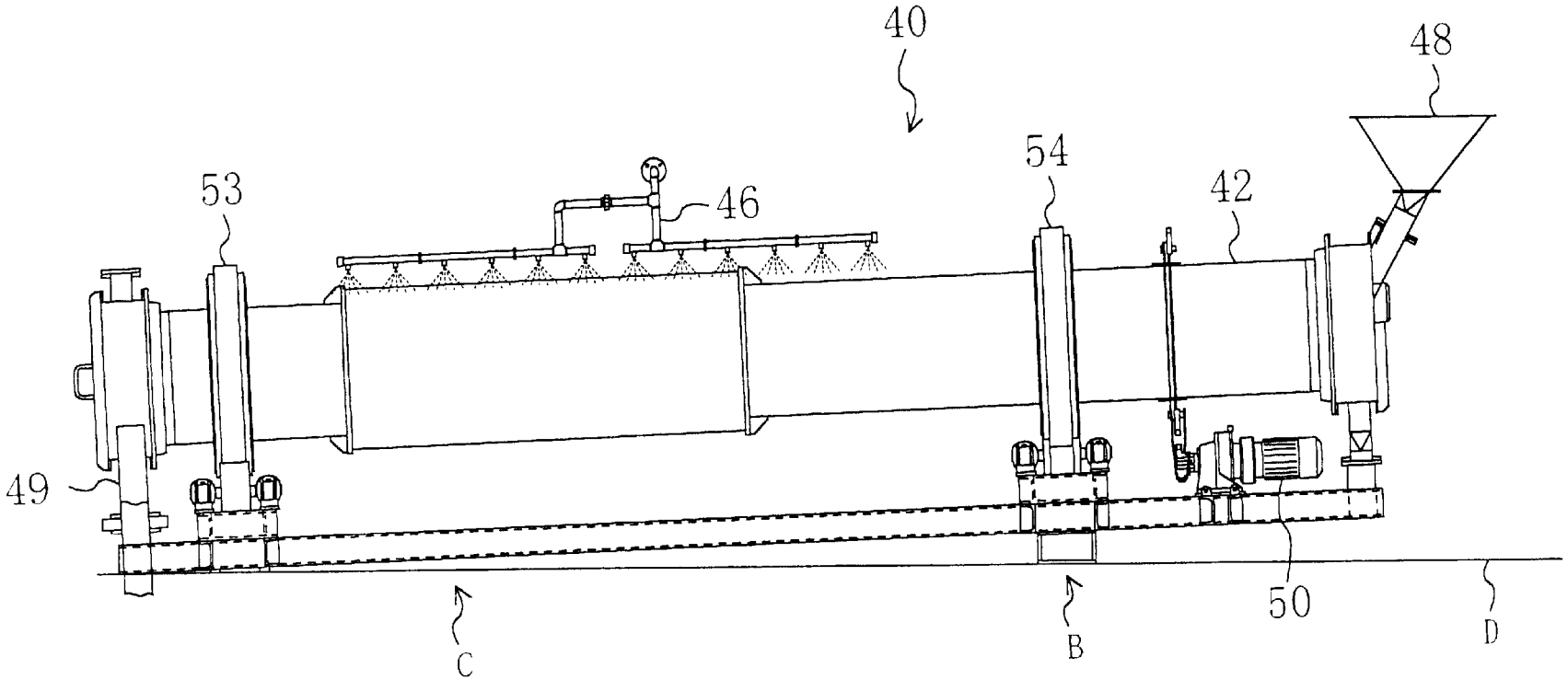
FIG. 4 is a side view outlining an exemplary embodiment of a rotary cooler according to the present invention.
Figure 5A:
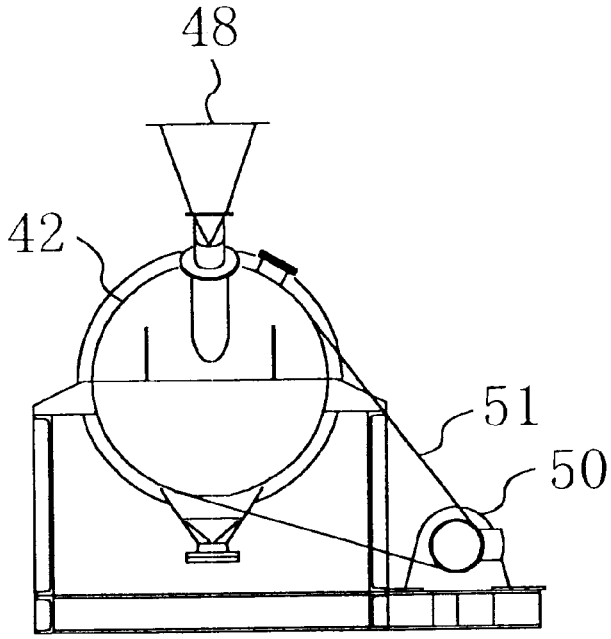
FIGS. 5A and 5B are cross-sectional views of the rotary cooler shown in FIG. 4.
Figure 5B:
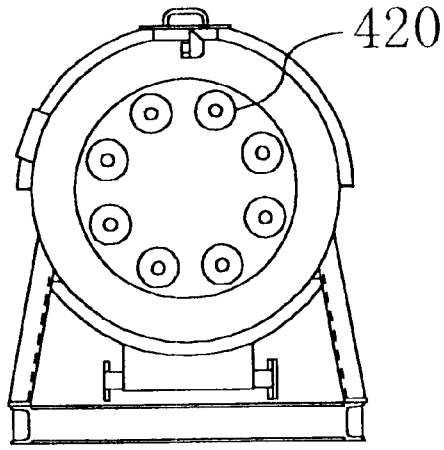

Next, a preferred embodiment of the rotary cooler according to the present invention will be described with reference to FIGS. 4 through 6. FIG. 4 illustrates the appearance of the rotary cooler 40. FIGS. 5A and 5B illustrate cross sections of the rotary cooler 40 taken at the arrows and C in FIG. 4. And FIG. 6 schematically illustrates an internal structure of the rotary cooler 40.

Once the material has been subjected to the hydrogen pulverization process, the rack 30 containing the material is reloaded in its entirety into the material transporter 26 while avoiding direct contact with the air, and then transported to the rotary cooler 40. At this point in time, the temperature of the material pulverized with hydrogen is partially about 50° C. to about 60° C. Thus, the material should be cooled down using the rotary cooler 40 to lower the temperature quickly. Specifically, even if the exposed part of the material packs has been cooled down to about room temperature as a result of cooling inside the hydrogen furnace, heat might be still generated when the material is taken out of the packs and stirred up, for example. This is because when another part of the material, which was located deep inside the packs and has not been cooled down enough yet, comes into direct contact with the air, oxidation occurs between them. To avoid such a situation, the entire material should be cooled down sufficiently using the rotary cooler 40.

Figure 6:
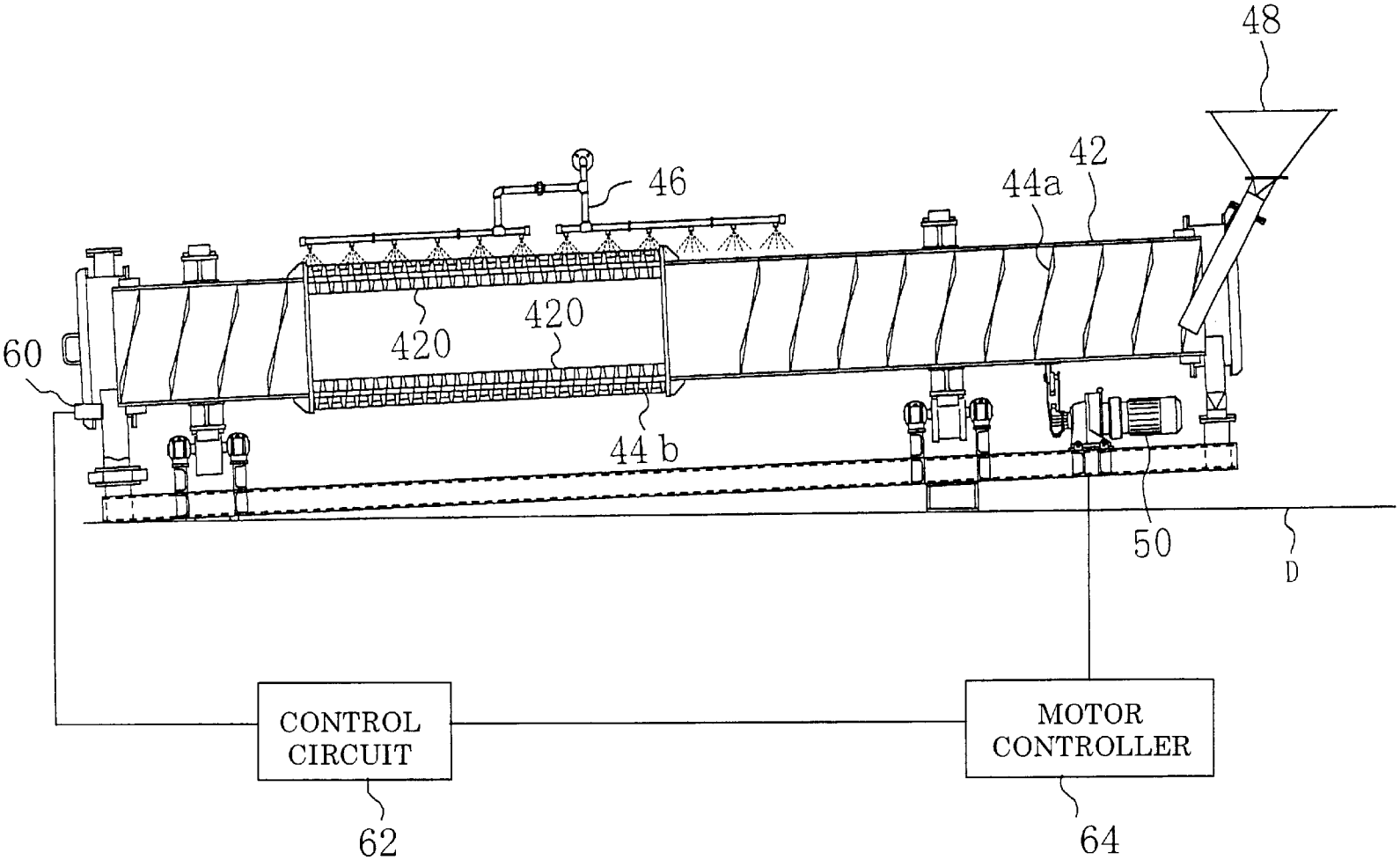
FIG. 6 schematically illustrates an internal structure of the rotary cooler shown in FIG. 4.

As shown in FIGS. 4 through 6, the rotary cooler 40 according to the present invention includes: a cooling cylinder 42 in which spiral fins 44*a* and 44*b* are provided; and a sprinkler 46 for cooling down the material by sprinkling the cooling cylinder 42. The cooling cylinder 42 is supported in a freely rotatable position by supporting mechanisms 53 and 54 and driven and rotated by a motor 50. The drive force of the motor is transmitted to the cooling cylinder 42 via a belt 51 shown in FIG. 5A.

Both ends of the cooling cylinder 42 are connected to material injection and ejection ports 48 and 49. The material injection port 48 is slightly inclined upward from a horizontal reference line (i.e., the direction parallel to the floor plane D) and located above the material ejection port 49. The angle of inclination may be 2 to 10 degrees. Accordingly, as the cooling cylinder 42 rotates, the material powder inside the cooling cylinder 42 is transported from the material injection port 48 toward the material ejection port 49.

In the illustrated embodiment, the outer diameter of the cooling cylinder 42 is about 1200 mm, and the length thereof is about 6 m to about 7 m. The cooling cylinder 42 should preferably be made of stainless steel such as SUS304 so as not to contaminate the material with rust.

The cooling cylinder 42 includes: a buffer zone for temporarily storing the material powder that has been supplied through the material injection port 48; and a cooling zone for efficiently cooling down the material powder. In the buffer zone, a spiral fin 44*a* is attached to the inner wall of a single big cylinder with an inner diameter of 650 mm, for example. In the cooling zone on the other hand, a number of fine cylinders 420 with an inner diameter of about 150 mm, for example, are provided inside the cylinder 42 as shown in FIGS. 5B and 6. Thus, part of the cylinder 42 in the cooling zone is easily cooled down with the water that has been ejected out of the sprinkler 46. Each of the fine cylinders 420 in the cooling zone is also provided with a spiral fin 44*b* on the inner wall thereof. In this manner, the inside of the cylinder is divided into multiple sections such that the material can be cooled down efficiently with the sprinkled water by contacting as much part as possible of the material with the inner circumference of the fine cylinder 420.

Since the material is stirred up inside the rotary cooler 40, oxidation and heat generation might be produced if the material is exposed to the air. Thus, according to this embodiment, a cooling process is carried out with an inert gas supplied into the cooling cylinder 42. To prevent the oxidation and heat generation, the material injection port 48 of the cooling cylinder 42 should preferably be connected to an automatic loader to be described later.

The material ejection port 49 is an opening for taking the cooled material out of the rotary cooler 40 into the atmosphere, and a temperature sensor is provided near the opening. The material, which has been cooled down sufficiently by the rotary cooler 40 and taken out through the material ejection port 49, is transported to a fine pulverizer, which pulverizes the material more finely.

For example, it takes about 30 to 50 minutes for the rotary cooler 40 to cool down 500 kg of material. The cooling cylinder 42 is driven at an optimum speed, e.g., within the range from 2 to 8 revolutions per minute (rpm), in accordance with the output of the temperature sensor 60 placed near the ejection port 49, as shown in FIG. 6. The output from the temperature sensor 60 is input onto a control circuit 60 which is connected with a motor controller 62. If it is determined that the temperature of the material is relatively high, then the speed of the cylinder 42 is lowered by the motor controller 62 such that the material can be cooled down sufficiently. Accordingly, the material can be cooled down to a predetermined temperature or less just as intended.

Automatic Loader

An automatic loader is used in this embodiment for unloading the pulverized material from the material transporter 26 and then loading the material into the material injection port 48 of the rotary cooler 40. When the material is unloaded from the transporter 26, the inside of the material contained in the material packs 32 might be at a relatively high temperature and relatively active. Accordingly, if the material is taken out of the material packs 32 in the air, oxidation and heat generation might be produced. Heat is much less likely to be generated during this takeout if the material has been cooled down sufficiently inside the hydrogen furnace 10. Nevertheless, since the hydrogen furnace 10 should operate for a longer time, the throughput decreases. Thus, according to this embodiment, the material is taken out of the material packs 32 within an inert gas environment.

Figure 9:
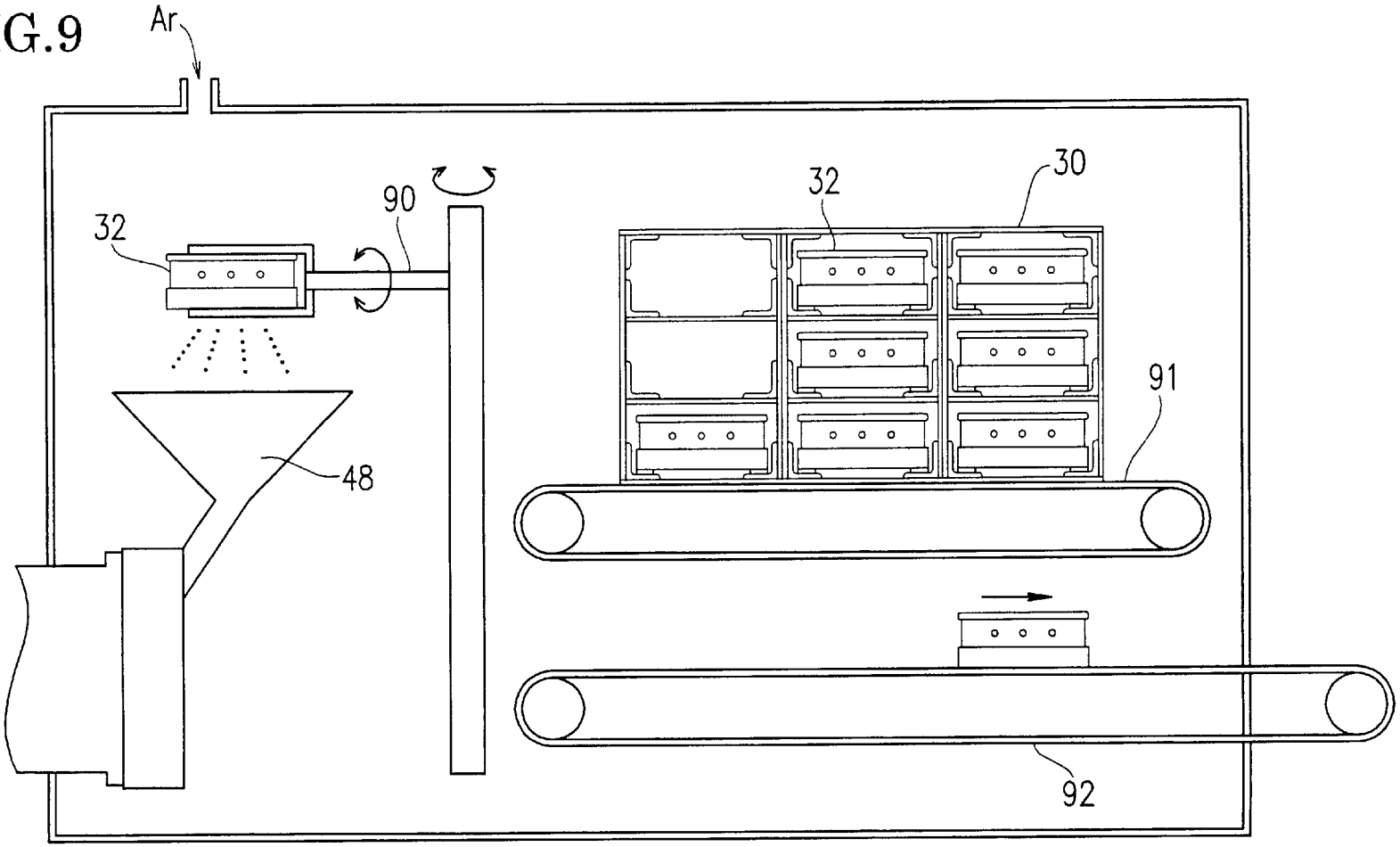
FIG. 9 schematically illustrates an exemplary automatic loader according to the present invention.

FIG. 9 illustrates an embodiment of the automatic loader. As shown in FIG. 9, the loader includes: a first belt 91 for mounting the rack 30 thereon and carrying it to the destination; and a second belt 92 for carrying the empty packs 32, from which the material has been taken out, away from the loader.

A pusher (not shown) is provided on the back of the rack 30 to push the packs 32 forward (i.e., in a direction normal to FIG. 9). The multiple packs 32 loaded in the rack 30 are pushed forward one by one by the pusher. Thereafter, the packs 32 pushed out are gripped by a robot arm 90, which rotates around a supporting shaft, one after another and then transported upward, i.e., toward the material injection port 48 of the rotary cooler 40, as the supporting shaft rotates. When each pack 32 is located just over the injection port 48, the pack 32 is turned upside down. As a result, the material contained in the pack 32 is introduced into the rotary cooler 40 and subjected to the cooling process. It should be noted that the robot arm 90 operates following a preset program.

According to this embodiment, the automatic loader further includes a housing, which is enclosed to form a substantially airtight space. The housing is provided with an opening for receiving the rack 30 containing the pulverized material in its entirety. A door is also provided to open or close the opening. A duct for supplying an inert gas into the housing is connected to the automatic loader, and the material is taken out within an inert gas environment (e.g., argon gas environment). Thus, it is possible to suppress the oxidation of the rare-earth alloy magnetic material.

While the pulverized material is carried from inside the material packs 32 to the rotary cooler 40, the material located inside and bottom of the packs 32 is exposed to the ambient gas. However, since the ambient gas is an inert gas, there is no concern about oxidation reaction.

Method for Producing Magnet

Hereinafter, an embodiment of the inventive method for producing a magnet will be described.

First, a material alloy with a desired composition for an R—T—(M)—B magnet is prepared by a known strip-casting technique and stored in a predetermined container. The thickness of the material alloy prepared by the strip-casting technique is in the range from 0.03 mm to 10 mm, both inclusive. The strip-cast alloy contains $R_2T_{14}B$ crystal grains and R-rich phases existing dispersively in the grain boundaries of the $R_2T_{14}B$ crystal grains. The sizes of the $R_2T_{14}B$ crystal grains are in the range from 0.1 $\mu$m to 100 $\mu$m, both inclusive, in the minor axis direction and in the range from 5 $\mu$m to 500 $\mu$m, both inclusive, in the major axis direction. The thickness of the R-rich phases is 10 $\mu$m or less. Preferably, the material alloy has been roughly pulverized into flakes with an average size of 1 to 10 mm before the alloy is subjected to the hydrogen pulverization process. A method for preparing a strip-cast alloy is disclosed by U.S. Pat. No. 5,383,978, for example.

Next, the roughly pulverized material alloy is introduced into the material packs 32, which are subsequently loaded into the rack 30. Thereafter, the rack 30 loaded with the material packs 32 is transported to the front of the hydrogen furnace 10 using the material transporter 26 and then loaded into the hydrogen furnace 10. At this point in time, the loading chamber 12 and the material transporter 26 do not have to be filled with the inert gas.

Figure 7:
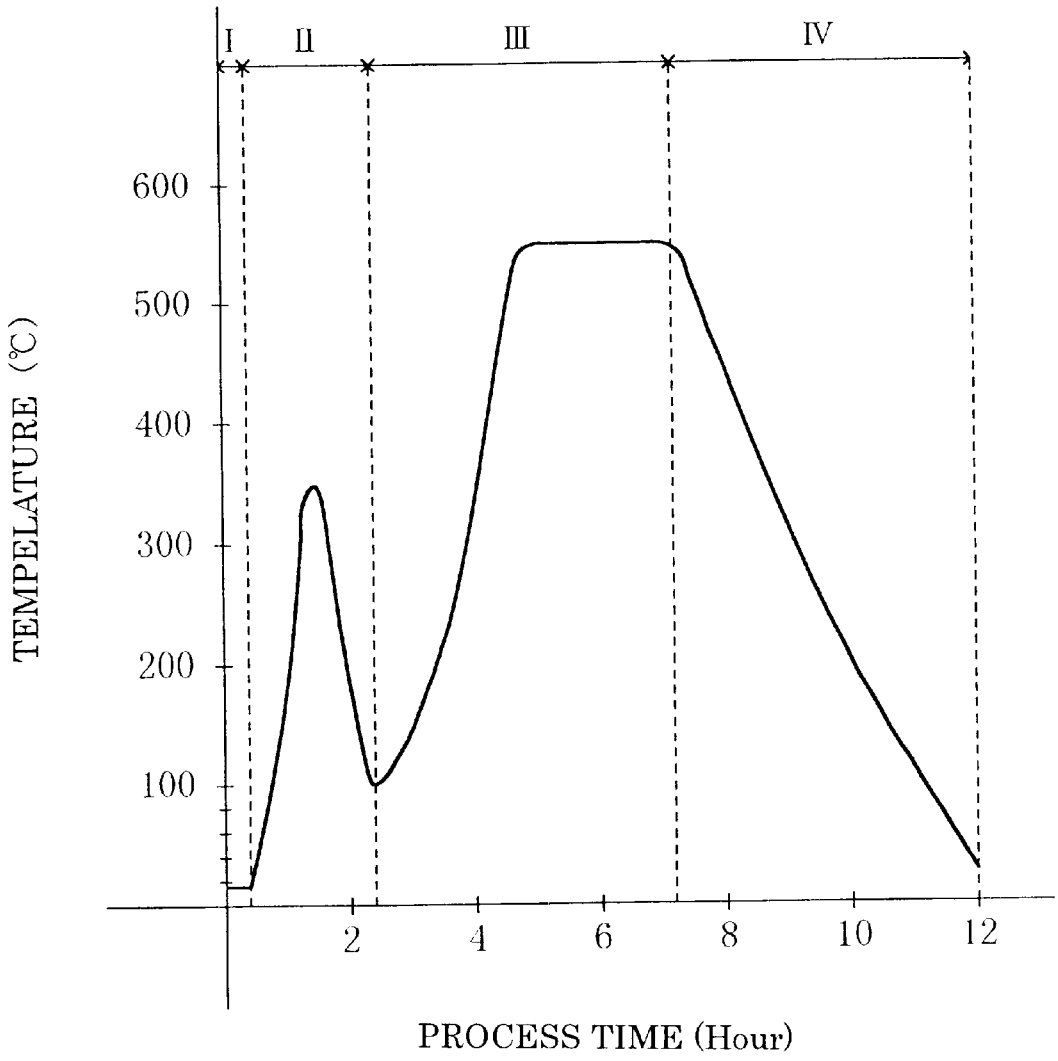
FIG. 7 is a graph illustrating a temperature profile during a hydrogen pulverization process.

Then, the cap 18 of the hydrogen furnace 10 is closed to start the hydrogen pulverization process. The hydrogen pulverization process may be performed in accordance with the temperature profile shown in FIG. 7, for example. In the example illustrated in FIG. 7, first, a vacuum pumping process step I is performed for 0.5 hour and then a hydrogen occlusion process step II is carried out for 2.5 hours. In the hydrogen absorption process step II, hydrogen gas is supplied into the furnace to create hydrogen environment within the furnace. In this case, the pressure of hydrogen can be preferably set in the range from about 200 to about 400 kPa.

Subsequently, a dehydrogenation process step III is conducted at a low pressure of 0 to 3 Pa for 5.0 hours and then a material cooling process step IV is performed for 5.0 hours with argon gas supplied into the furnace.

In the cooling process step IV, when the ambient temperature inside the furnace is relatively high (e.g., over 100° C.), the inert gas at room temperature is supplied into the hydrogen furnace 10, thereby cooling down the material. Thereafter, when the temperature of the material reaches a relatively low level (e.g., 100° C. or less), the inert gas that has been cooled down to less than room temperature (e.g., lower than room temperature by about 10° C.) is preferably supplied into the hydrogen furnace 10 in view of cooling efficiency. The flow rate of the argon gas may be in the range from about 10 $Nm^3$/min. to about 100 $Nm^3$/min.

Once the temperature of the material has lowered to about 20 to about 25° C., an inert gas approximately at room temperature (which is lower than room temperature by less than 5° C.) is preferably supplied into the hydrogen furnace 10 and we should wait the temperature of the material to reach around room temperature. In this manner, it is possible to prevent condensation from being produced inside the furnace when the cap 18 of the hydrogen furnace 10 is opened. The existence of too much water due to condensation should be avoided. This is because the water freezes or vaporizes in the vacuum pumping process step, thereby making it harder to create vacuum and making it longer to perform the vacuum pumping process step I.

Next, the unloading process will be described below.

First the material transporter 26 is substantially connected airtight to the loading chamber 12 of the hydrogen furnace 10, then both the material transporter 26 and loading chamber 12 are filled with the inert gas. If the formation of a large gap cannot be avoided between the material transporter 26 and the loading chamber 12, then the gap may be temporarily covered with some bellows-like enclosure. Such an enclosure may be attached to either the material transporter 26 or the loading chamber 12 in a freely expandable state.

At a point in time a sufficient quantity of inert gas has been supplied into the material transporter 26 and the loading chamber 12, the cap 18 of the hydrogen furnace 10 is opened. Then, the arm of the material transporter 26 is made to reach into the hydrogen furnace 10 and grip and take out the rack 30 loaded with the material packs 32. The exposure of the pulverized material to the air is avoidable in this manner. Accordingly, it is possible to prevent the material from being oxidized and generating heat, thus greatly improving the magnetic properties of a resultant magnet.

It should be noted that when the cap 18 of the hydrogen furnace 10 is opened, the argon gas is released from inside the furnace into the loading chamber 12. Therefore, if the volume of the hydrogen furnace 10 is much greater than that of the loading chamber 12, the inert gas can be supplied from the furnace 10 into the chamber 12 in a quantity large enough to prevent oxidation just by opening the cap 18 of the furnace 10. That is to say, there is no need to supply the inert gas into the loading chamber 12 in advance. In other words, the hydrogen furnace 10 itself can function as inert gas supply means in such a case.

Next, the material transporter 26 is moved to the front of the automatic loader for the rotary cooler 40. Then, the automatic loader grips the material packs 32 on the rack 30 one by one and supplies the material from each of these packs 32 into the material injection port 48 of the rotary cooler 40. The material is cooled down by sprinkled water while moving inside the rotary cooler 40, and finally ejected through the material ejection port 49. In this process step, since the embrittled material is stirred up by the rotary cooler 40, the material is pulverized even more finely. Thus, as for a strip-cast alloy, the material that has been ejected through the ejection port can be directly pulverized with a jet mill.

In the illustrated embodiment, the material is supposed to be taken out after the material has been cooled down to around room temperature inside the hydrogen furnace 10. However, even if the material at a high temperature (e.g., 40 to 80° C.) is taken out as it is, particularly serious oxidation is not produced because the material is not exposed to the air. If the material is taken out at a high temperature in this manner, then the material should be cooled down by the rotary cooler 40 for a longer time. The rotary cooler 40 with the construction exemplified in the foregoing embodiment realizes highly efficient cooling. Accordingly, to improve the productivity, the material at a relatively high temperature is preferably taken out without taking so much time to cool the material down inside the hydrogen furnace 10 and the cooling process should be carried out mainly at the rotary cooler 40.

Thereafter, the material powder, which has been cooled down to around room temperature, is further pulverized using a grinding machine such as a jet mill, thereby making fine powder of the material. Next, a lubricant is mixed into this fine powder and the mixture is compacted into a desired shape using a pressworking machine to obtain a compressed material compact. Then, the compact is subjected to a series of process steps including burning-off the lubricant in the compact, sintering, cooling and aging treatment, thereby producing a sintered magnet of a rare-earth alloy.

According to the foregoing embodiment, not only the productivity but also the magnetic properties of the resultant magnet are improved because oxidation of the material is avoidable. The following Table 1 exemplifies how the magnetic properties are improved according to the present invention:

TABLE 1

| | $B_r$ | $H_{cb}$ | $(BH)_{max}$ | $H_{cj}$ | $O_2$ |
|---|---|---|---|---|---|
| Prior Art | 1.347 | 899 | 345 | 903 | 8300 |
| This Invention | 1.342 | 1001 | 342 | 1085 | 4500 |

where $B_r$ represents remanence [T], $H_{cb}$ and $H_{cj}$ represent coercivity [kA/m] $(BH)_{max}$ represents maximum energy product [$kJ/m^3$] and $O_2$ is the concentration of oxygen in the sintered magnet [ppm]. As apparent from the table, the oxygen concentration in the magnet according to the present invention is reduced and its coercivity is improved.

In the foregoing embodiment, the present invention has been described as being applied to pulverizing a rare-earth alloy magnet material with hydrogen. However, the present invention is not limited to such a specific embodiment, but is applicable to the hydrogen pulverization process of any other magnet material, because advantageous effects are attainable in terms of prevention of condensation, for example.

Also, the present invention is applied to a strip-cast alloy in the foregoing description, but is not limited thereto. For example, the present invention is suitably applicable to pulverizing an alloy that has been rapidly solidified by a centrifugal casting technique as disclosed in Japanese Laid-Open Publication No. 9-31609.

Moreover, the present invention is supposed to be carried out using a batch-type furnace in the foregoing embodiment. Optionally, the present invention is also implementable using a continuous furnace, in which hydrogen processing chamber, heating chamber and cooling chamber are connected in series together.

According to the present invention, since the material just pulverized with hydrogen is not exposed to the air, the properties of the material do not deteriorate due to oxidation, and magnetic powder with excellent magnetic properties can be mass-produced. In addition, the material may be cooled down inside the hydrogen furnace for a much shorter time, thus increasing the throughput. Furthermore, condensation inside the hydrogen furnace is avoidable because the penetration of the air into the hydrogen furnace is suppressible. As a result, it takes a shorter time to reduce the pressure inside the furnace to a desired level, and therefore, the productivity improves.

The present invention is applicable particularly effectively to pulverizing a quenched alloy or a rapidly-solidified alloy where a large quantity of rare-earth element is likely to be exposed on the surface of powder particles.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method for preparing a rare-earth alloy magnetic material powder, comprising the steps of:

pulverizing a rare-earth alloy magnetic material with hydrogen by using an apparatus including: a hermetically sealable hydrogen furnace, the furnace including a furnace body with an opening and a cap for closing the opening; a loading chamber for temporarily enclosing the rare-earth alloy magnetic material when the rare-earth alloy magnetic material is unloaded from the furnace body through the opening; and means for supplying an inert gas into the loading chamber; and unloading the rare-earth alloy magnetic material from the apparatus and moving the material into an inert gas environment while supplying the inert gas into the loading chamber of the apparatus.

2. The method of claim 1, further comprising the step of receiving the rare-earth alloy magnetic material that has been unloaded from the furnace body and then transporting the material using a transporter including means for supplying the inert gas into the transporter itself.

3. The method of claim 1 or 2, further comprising the step of cooling down the rare-earth alloy magnetic material that has been pulverized with hydrogen by supplying the inert gas into the hydrogen furnace of the apparatus.

4. The method of claim 3, wherein the inert gas supplied into the hydrogen furnace of the apparatus is circulated and used cyclically.

5. The method of claim 4, wherein the material is cooled down to a predetermined temperature using, as the inert gas supplied into the hydrogen furnace of the apparatus, a cooled inert gas and then further cooled down using an inert gas at about room temperature.

6. The method of one of claim 2, further comprising the step of unloading the rare-earth alloy magnetic material from the transporter inside a housing that is filled with the inert gas.

7. The method of claim 1, further comprising the step of cooling down the rare-earth alloy magnetic material inside a cooling system that is filled with the inert gas.

8. A method for producing a magnet comprising the steps of:

pulverizing a rare-earth alloy magnetic material using an apparatus including:

a hermetically sealable hydrogen furnace, the furnace including a furnace body with an opening and a cap for closing the opening;

a loading chamber for temporarily enclosing the rare-earth alloy magnetic material when the rare-earth magnetic material is unloaded from the furnace body through the opening; and means for supplying an inert gas into the unloading chamber;

unloading the rare-earth alloy magnetic material from the apparatus and moving the material into the loading chamber filled with the inert gas;

transporting the rare-earth alloy magnetic material that has been unloaded from the apparatus using a transporter filled with the inert gas;

unloading the rare-earth alloy magnetic material from the transporter inside a housing that is filled with the inert gas, and cooling down the rare-earth alloy magnetic material inside a cooling system that is filled with the inert gas;

making fine powder of the rare-earth alloy magnetic material by further pulverizing the rare-earth alloy magnetic material; and producing a magnet by compacting and sintering the fine powder of the rare-earth alloy magnetic material.

9. The method of claim 8, further comprising the step of cooling down the rare-earth alloy magnetic material that has been pulverized with hydrogen by supplying the inert gas into the hydrogen furnace of the apparatus.

10. The method of claim 9, wherein the inert gas supplied into the hydrogen furnace of the apparatus is circulated and used cyclically.

11. The method of claim 9 or 10, wherein the material is cooled down to a predetermined temperature using, as the inert gas supplied into the hydrogen furnace of the apparatus, a cooled inert gas and then further cooled down using an inert gas at about room temperature.

12. A method for preparing a rare-earth alloy magnetic material powder, comprising the steps of:

embrittling a rare-earth alloy magnetic material alloy within a furnace with hydrogen supplied into the furnace, the alloy containing: $R_2T_{14}B$ crystal grains, where R is a rare-earth element, T is Fe or a compound of Fe and at least one transition metal and B is boron; and R-rich phases existing dispersively in grain boundaries of the $R_2T_{14}B$ crystal grains, the sizes of the $R_2T_{14}B$ crystal grains being in the range from 0.1 $\mu$m to 100 $\mu$m, both inclusive, in a minor axis direction and in the range from 5 $\mu$m to 500 $\mu$m, both inclusive, in a major axis direction, the thickness of the alloy being in the range from 0.03 mm to 10 mm, both inclusive; and unloading the alloy from the furnace within an inert gas environment.

13. A method for preparing a rare-earth alloy magnetic material powder, comprising the steps of:

embrittling a rare-earth magnetic alloy within a furnace with hydrogen supplied into the furnace, the rare-earth magnetic alloy having been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal and B is boron, have grown in the alloy in the thickness direction thereof; and unloading the alloy from the furnace within an inert gas environment.

14. The method of claim 12 or 13, further comprising the steps of:

cooling down the alloy, which has been embrittled with hydrogen, within the furnace; and moving the alloy, which has been unloaded from the furnace, into a cooling system and cooling down the alloy within the cooling system.

15. The method of claim 14, further comprising the step of introducing the alloy into a process container and loading the container into the furnace before the alloy is embrittled with hydrogen, wherein in the step of unloading the alloy from the furnace, the process container is unloaded from the furnace within the inert gas environment, and wherein the alloy is cooled down within the cooling system after having been taken out of the process container.

16. The method of claim 12 or 13, wherein the inert gas environment is argon or helium gas environment.

17. The method of claim 12 or 13, further comprising the step of cooling down the alloy within an inert gas environment after the alloy has been unloaded from the furnace.

18. The method of claim 14, wherein the alloy is cooled down while being stirred up within an inert gas environment.

19. The method of claim 17, wherein the alloy is cooled down while being stirred up within the inert gas environment.

20. A method for preparing a rare-earth alloy magnetic material powder, comprising the steps of:

embrittling a rare-earth magnetic alloy within a furnace with hydrogen supplied into the furnace, the rare-earth magnetic alloy having been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal and B is boron, have grown in the alloy in the thickness direction thereof; and unloading the alloy from the furnace and cooling the alloy down within a cooling system while stirring the alloy up within an inert gas environment.

21. The method of claim 20, wherein the cooling system includes a cylindrical member that is driven to rotate, and wherein the number of revolutions per minute of the cylindrical member is controlled based on the output of means for sensing the temperature of the alloy.

22. A method for producing a magnet, comprising the steps of:

embrittling a rare-earth alloy magnetic material alloy within a furnace with hydrogen supplied into the furnace, the alloy containing: $R_2T_{14}B$ crystal grains, where R is a rare-earth element, T is Fe or a compound of Fe and at least one transition metal and B is boron; and R-rich phases existing dispersively in grain boundaries of the $R_2T_{14}B$ crystal grains, the sizes of the $R_2T_{14}B$ crystal grains being in the range from 0.1 $\mu$m to 100 $\mu$m, both inclusive, in a minor axis direction and in the range from 5 $\mu$m to 500 $\mu$m, both inclusive, in a major axis direction, the thickness of the alloy being in the range from 0.03 mm to 10 mm, both inclusive;

unloading the alloy from the furnace within an inert gas environment;

compacting powder of the alloy; and sintering the compacted alloy.

23. A method for producing a magnet, comprising the steps of:

embrittling a rare-earth magnetic alloy within a furnace with hydrogen supplied into the furnace, the rare-earth magnetic alloy having been prepared by rapidly quenching a molten alloy to a thickness in the range from 0.03 mm to 10 mm, both inclusive, such that $R_2T_{14}B$ crystal grains, where R is a rare-earth element, T is Fe or a compound of Fe and at least one transition metal and B is boron, have grown in the alloy in the thickness direction thereof;

unloading the alloy from the furnace within an inert gas environment;

compacting powder of the alloy; and sintering the compacted alloy.

* * * * *